US011820464B2

(12) United States Patent
Sorrentino

(10) Patent No.: US 11,820,464 B2
(45) Date of Patent: Nov. 21, 2023

(54) CONTOURED BOAT WINDSHIELD AND BOAT WITH WITH CONTOURED WINDSHIELD

(71) Applicant: Donald Michael Sorrentino, Alton, NH (US)

(72) Inventor: Donald Michael Sorrentino, Alton, NH (US)

( * ) Notice: Subject to any disclaimer, the term of this patent is extended or adjusted under 35 U.S.C. 154(b) by 190 days.

(21) Appl. No.: 17/368,518

(22) Filed: Jul. 6, 2021

(65) Prior Publication Data

US 2022/0009594 A1 Jan. 13, 2022

Related U.S. Application Data

(60) Provisional application No. 63/049,195, filed on Jul. 8, 2020.

(51) Int. Cl.
*B63B 19/02* (2006.01)

(52) U.S. Cl.
CPC ..... *B63B 19/02* (2013.01)

(58) Field of Classification Search
CPC ..... B63B 17/02; B63B 19/02; B63B 29/02
USPC ..... 114/361
See application file for complete search history.

(56) References Cited

U.S. PATENT DOCUMENTS 3,099,023 A * 7/1963 Buchholz ..... B63B 19/02 114/364
4,957,056 A * 9/1990 Martin ..... B63B 19/02 114/361
5,421,284 A * 6/1995 Wardavoir ..... B60F 3/003 114/361
7,421,969 B2 * 9/2008 Mercier ..... B63B 19/00 114/361

* cited by examiner

*Primary Examiner* — Daniel V Venne
(74) *Attorney, Agent, or Firm* — McLane Middleton, Professional Association

(57) ABSTRACT

The present invention is a contoured boat windshield with a top edge parallel to a bottom edge; a right and left side connecting the top and bottom edges; and at least one concave pane with a curvature that describes between 45 and 90 degrees of a circle and that is disposed between the top and bottom edges. The present invention is also a boat including a contoured boat windshield of the present invention and attachment means for attaching the windshield to the boat.

11 Claims, 12 Drawing Sheets

CONTOURED BOAT WINDSHIELD AND BOAT WITH WITH CONTOURED WINDSHIELD

CLAIM OF PRIORITY

This application claims the benefit of priority of U.S. Provisional Patent Application Ser. No. 63/049,195, filed on Jul. 8, 2020.

FIELD OF THE INVENTION

The present invention relates generally to boating and, specifically, to an improved windshield that provides a more comfortable experience for passengers within an open motorboat.

BACKGROUND

Where there are bodies of water, there is boating. Boating may be may be for pleasure, commercial, or military activities or simply for transportation. Many boats used for any of these broad purposes are open boats, or boats that do not include an enclosed space. Especially when a boat, such as a motorboat, travels at speed, a great deal of wind may be created within the boat. This wind may be uncomfortable for passengers within the boat. This well-known problem has been addressed by including windshields on such boats. Some boats include removable windshields. See, e.g. U.S. Pat. Nos. 5,203,277 and 7,845,304.

On pontoon boats, when windshields are included, they are generally placed midship, providing no protection for passengers in the bow of the boat. While including windshields on boats acknowledges the problem, current windshields generally only protect passengers directly behind the windshield. Anyone forward of the windshield or not closely behind it will receive no benefit from its inclusion. Any prior art windshield large enough to protect all passengers would be unwieldy, overly large, and non-aerodynamic. Therefore, there is a need for a boat with an aerodynamic windshield that protects passengers anywhere on the boat and is no larger than prior art windshields.

SUMMARY OF THE INVENTION

The present invention is a contoured boat windshield and a boat with a contoured windshield. It is understood that, although the contoured windshield of the present invention is envisioned for use with a boat, it may also be used in other motor vehicles and such use is considered to be within the scope of the present invention.

In its most basic form, the windshield of the present invention includes a top edge, a bottom edge, a right side, a left side, and at least one concave section whose curvature preferably describes between 45 and 90 degrees of a circle between the top and bottom edge of the windshield. The top and bottom edges of the windshield are preferably parallel to one another. Having the top and bottom edges parallel makes manufacture easier but, in some embodiments, the top and bottom edges may not be parallel. This variation may be to create a specific profile regarding the protected space behind the windshield or for aesthetics. The right and left sides may be parallel to one another, but given the curvature of the concave section, may lean toward one another such that the corners of the top edge of the windshield are closer to one another than the corners of the bottom edge.

The slipstream created over a prior art flat or slightly convex windshield during boat motion goes straight back over the top edge of the windshield. As such, only those directly behind the prior art windshield are fully protected from the slipstream. When the windshield of the present invention is disposed on a boat such that its concavity bulges aft, the slipstream created over the windshield during forward motion of the boat is projected up and then back. This provides for a much larger protected space behind the windshield of the present invention, both laterally along the length of the boat, and vertically up from the deck of the boat. The dimensions of the protected space will vary based on the boat's speed; the boat's length; the curvature of the concave section; the lateral and vertical position of the windshield on the boat; and the angle of the windshield at its attachment to the boat.

The concave section is preferably made of any material commonly used in the art of boat windshields, such as glass or plastics, such as acrylic, and polycarbonate, and high density polyethylene (HDPE). Many materials may be used considering durability, breakage protection, flexion, and long-term sun exposure. The preferred material is clear plastic consistent with commercial plastics such as polycarbonate and polyethylene which have good UV characteristics, clarity, and can be machined for manufacturing in sheets or custom molded in higher volume. In some embodiments, the windshield includes a substantially flat section below the concave section, between the concave section and the bottom edge of the windshield. As used herein, "substantially flat" may mean either completely flat or convex as compared to the concave section.

Preferred embodiments of the windshield of the present invention include adjustment means for adjusting the windshield's position relative to the boat. These adjustment means preferably include vertical angle adjustment means, lateral angle adjustment means, height adjustment means, position adjustment means, and rotation adjustment means.

The vertical angle adjustment means rotate the windshield vertically so that the distance between the top edge or the bottom edge and the deck of the boat is changed. If the vertical angle adjustment means are near the top of the windshield, then the top edge of the windshield may remain fairly stationary during vertical angle adjustment, while the bottom edge moves. If the vertical angle adjustment means are near the bottom of the windshield, then the bottom edge of the windshield may remain fairly stationary during vertical angle adjustment, while the top edge moves. If the vertical angle adjustment means are positioned between the top and bottom of the windshield, then both the bottom and top edges of the windshield will move during vertical angle adjustment. This description explains what is meant by "vertical angle adjustment" herein. It is preferred that the vertical angle adjustment means provide at least 20 degrees, and preferably 30-60 degrees, of adjustment so as allow for an optimal angle for the windshield's use with various sizes of boats and desired protected spaces behind the windshield. The lateral angle adjustment means rotate the windshield laterally so that the distance between the right or left sides and the hull of the boat is changed. If the lateral angle adjustment means are near the right of the windshield, then the right side of the windshield may remain fairly stationary during lateral angle adjustment, while the left side moves. If the lateral angle adjustment means are near the left of the windshield, then the left side of the windshield may remain fairly stationary during lateral angle adjustment, while the right side moves. If the lateral angle adjustment means are positioned between the right and left of the windshield, then both the right and left sides of the windshield will move during lateral angle adjustment. This description explains what is meant by "lateral angle adjustment" herein.

The height adjustment means move the entire windshield up or down relative to the deck of the boat. The position adjustment means move the entire windshield laterally right or left relative to the hull of the boat.

The rotation adjustment means spin the entire windshield relative to the deck of the boat. That is to say, a standard rotation position for the windshield may have the top and bottom edges substantially parallel to the deck of the boat. The rotation adjustment means may spin the windshield so that one corner of the top edge of the windshield is closer to the deck than the other corner of the top edge. In other words, the rotation adjustment means may rotate the windshield so that one side or the other points down or up. This description explains what is meant by "rotation angle adjustment" herein.

It is understood that any combination of these adjustment means may be combined in a single adjustment device. In some embodiments, the various adjustments effected by the adjustment means are achieved through actuators that may be programmable and/or automatically controlled. One of ordinary skill in the art will recognize that there are many structures commonly used in the art for achieving each of the abovementioned adjustment means, such as hinges, actuators, slides, tracks, etc. Each of these devices is considered to be within the scope of the present invention.

Preferred embodiments of the windshield of the present invention include attachment means for attaching the windshield to a boat. One of ordinary skill in the art will recognize that there are many structures commonly used in the art for achieving such attachment, such as screws, clamps, clip type mounts, suction cups, and adhesives. It is understood that the attachment means may be integrated with one or more of the adjustment means discussed above.

Some embodiments of the attachment means include a hull plate affixed to the hull of the boat and a windshield plate affixed to the windshield, where the windshield plate is attached by a single screw to the hull plate and can rotate around that screw. This rotation achieves vertical, lateral, or rotation adjustment, depending on how the hull plate and windshield plate are situated. In other embodiments, the attachment means includes a mount that is affixable to the hull of the boat, where the windshield will be secured in place when disposed on the mount. If several of the mounts are included in different positions laterally across the hull, and the windshield may be moved between such mounts, then the mounts act as both attachment means and position adjustment means.

The boat of the present invention includes at least the windshield of the present invention in its most basic form, as described above, and attachment means for attaching the windshield to the boat. It is understood that, in some embodiments of the boat of the present invention, the windshield is integrated into the boat upon its first construction. In other embodiments, the windshield is retrofitted onto the boat. In all embodiments, the windshield is disposed on the boat so that its concavity faces in the same direction as the bow of the boat. That is to say, a passenger viewing the windshield from the boat's aft would see the concave section of the windshield as convex. This is true whether the windshield is mounted at the bow, as is preferred, mid-ship, as is common with prior art boats, or elsewhere. The attachment means in either of these embodiments are considered to be within the scope of the present invention. In some embodiments, the windshield of the boat of the present invention also includes a substantially flat section below the concave section, as described above. Different embodiments of the boat of the present invention also include any or all of the adjustment means discussed above. The preferred boat of the present invention is a pontoon boat where the windshield is disposed at the bow of the boat, rather than at midship, as is common with prior art pontoon boats. In this way, all passengers of the pontoon boat of the present invention, even those seated near the bow, will benefit from the protected space created by the windshield of the present invention.

These aspects of the present invention are not meant to be exclusive and other features, aspects, and advantages of the present invention will be readily apparent to those of ordinary skill in the art when read in conjunction with the following description and accompanying drawings.

DETAILED DESCRIPTION

Figure 1A:
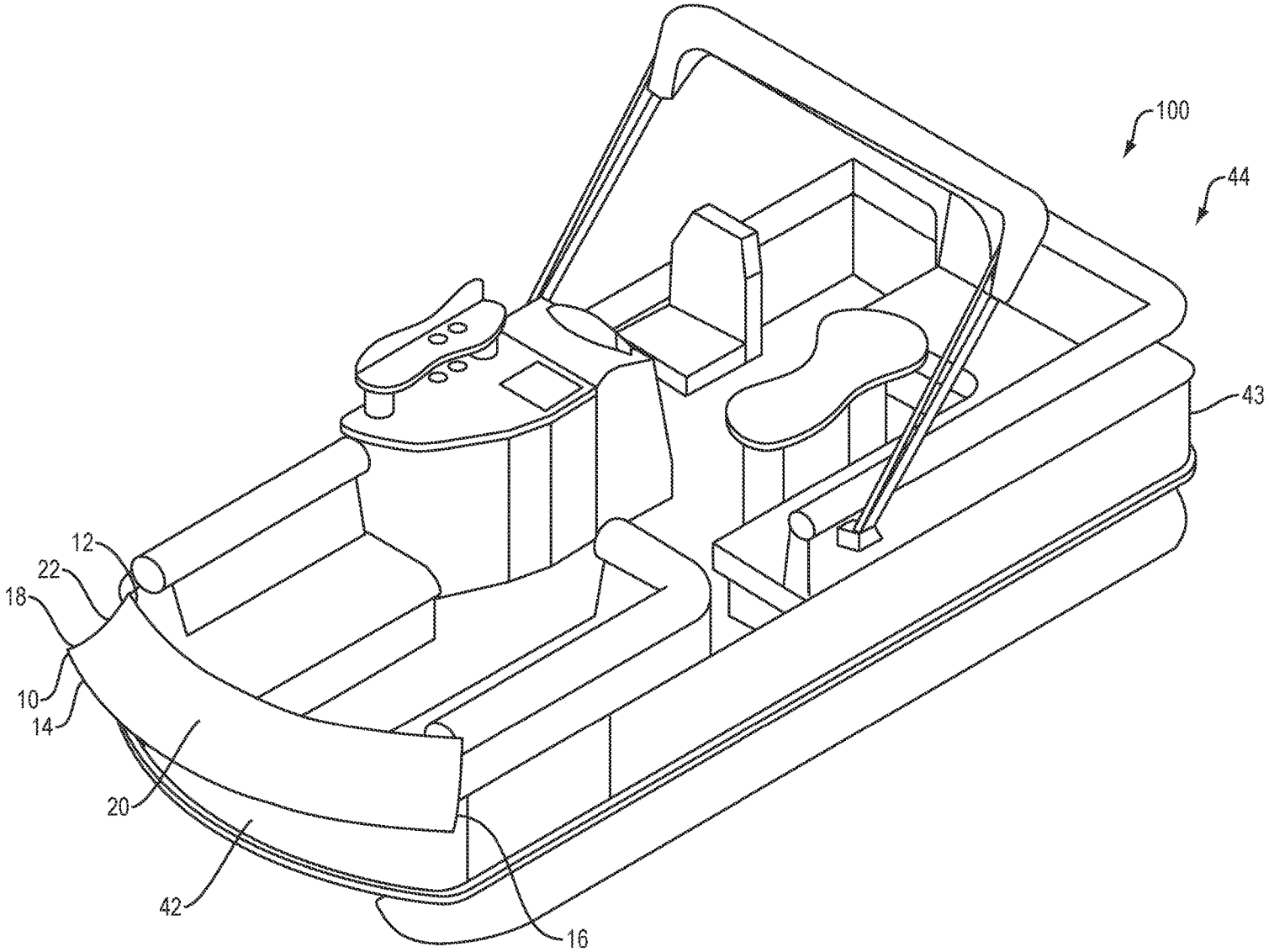
FIG. 1*a* is a perspective view of a boat of the present invention including a windshield of the present invention.
Figure 1B:
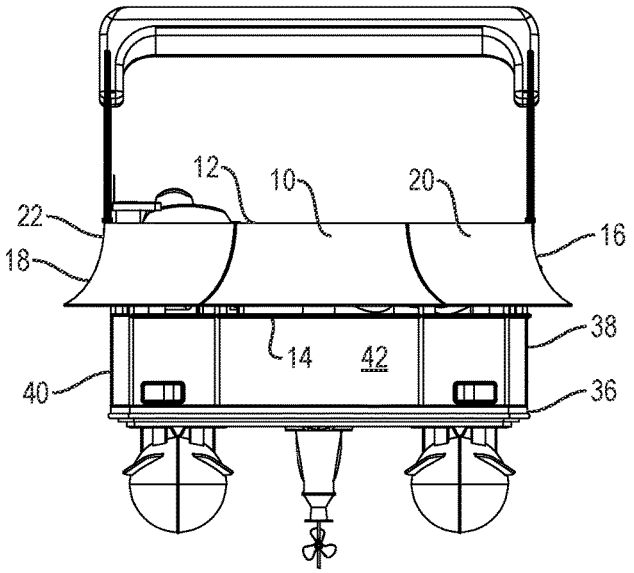
FIG. 1*b* is a front view of a boat of the present invention including a windshield of the present invention.
Figure 1C:
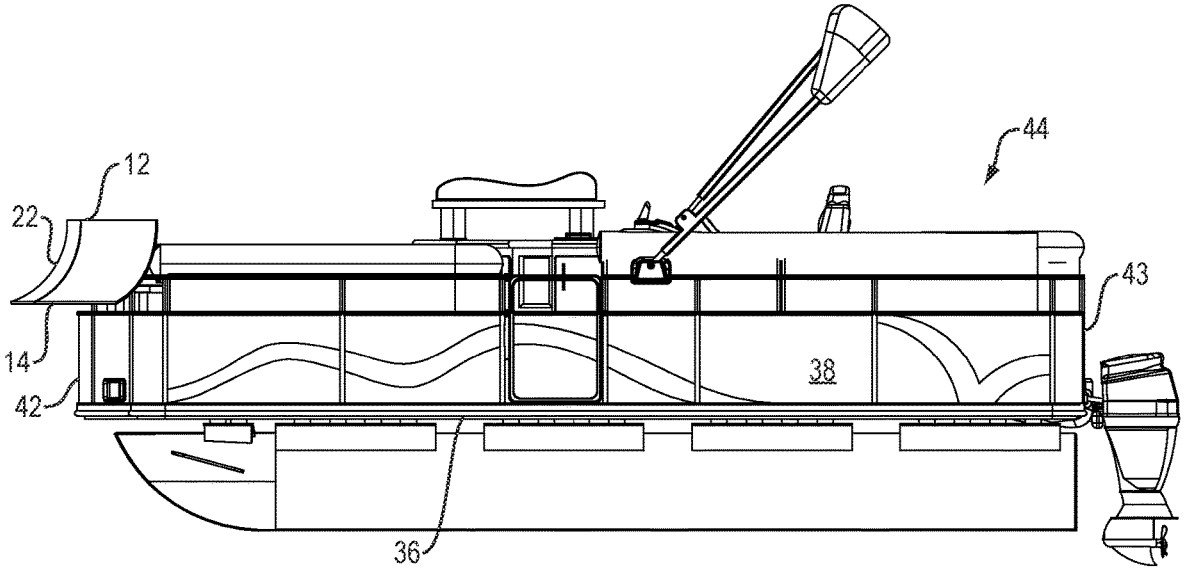
FIG. 1*c* is a side view of a boat of the present invention including a windshield of the present invention.

Referring first to FIG. 1*a*, a perspective view of boat 100 of the present invention is provided. Boat 100 is a pontoon boat 44 that includes windshield 10 of the present invention. Windshield 10 includes top edge 12, bottom edge 14, right side 16, and left side 18. Windshield 10 is a single concave section 20 spanning the width of bow 42. Concave section 20 has curvature 22 that provides the concavity of concave section 20, and is discussed in more detail below with respect to FIG. 5. The curvature 22 or concavity of concave section 20 faces the same direction as bow 42. Concave section 20 would appear convex from the point of view of a passenger of boat 100. When it is said herein that concave section 20 "bulges" toward the aft 43 (as shown in FIGS. 1*b* and 1*c*) of boat 100, a reference to this aspect of the concavity facing forward is being made. While top edge 12 and bottom edge 14 are substantially parallel, right side 16 and left side 18 are not parallel due to the curvature 22. In other words, the corners of top edge 12 are closer to one another than the corners of bottom edge 14. Concave section 20 is made of glass, acrylic plastic, or polycarbonate plastic.

Referring now to FIGS. 1*b* and 1*c*, front and side views of pontoon boat 44 are provided. Pontoon boat 44 has right boat side 38, left boat side 40, deck 36, and bow 42. Unlike in FIG. 1*a*, the windshield 10 in FIGS. 1*a* and 1*b* includes three sections. While a pontoon boat 44, as shown, usually has a flat bow 42, other boats 100 of the present invention may have different shaped bows 42, such as bows that come to a point. A single section, as shown in FIG. 1*a* may be suitable for a pontoon boat 44. Separate and/or multiple sections, as shown in FIGS. 1*b* and 1*c* may be particularly suitable for such boats 100 with different shaped bows 42. Separate and/or multiple sections may also be easier to manufacture than a single section.

Figure 2A:
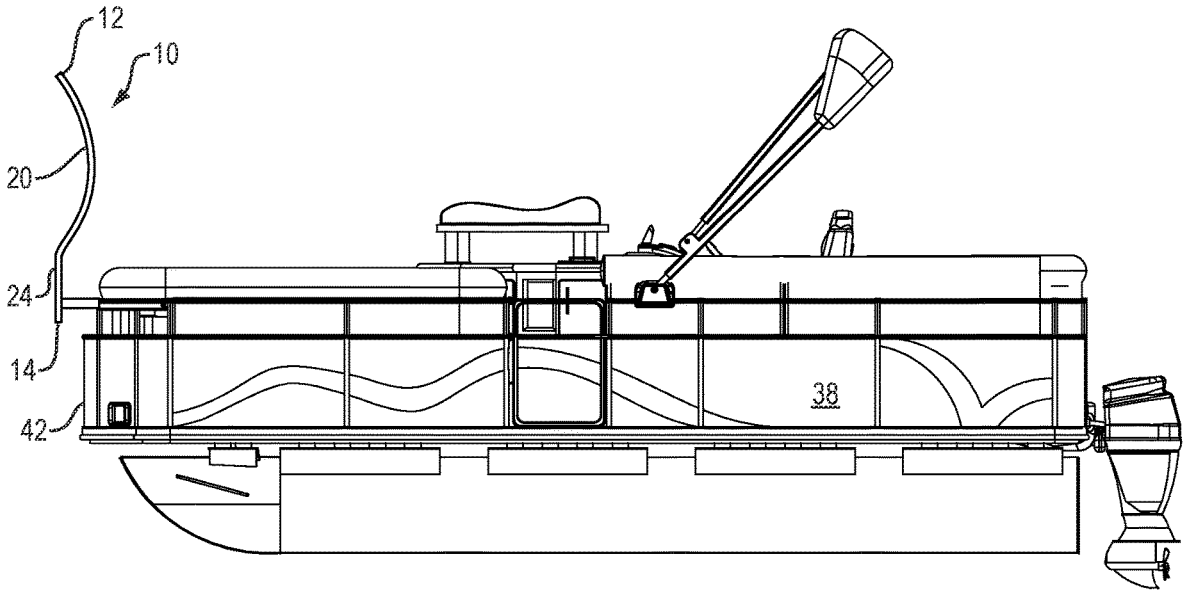
FIGS. 2*a* and 2*b* are side views of the boat of the present invention including a windshield of the present invention that includes a substantially flat section.
Figure 2B:
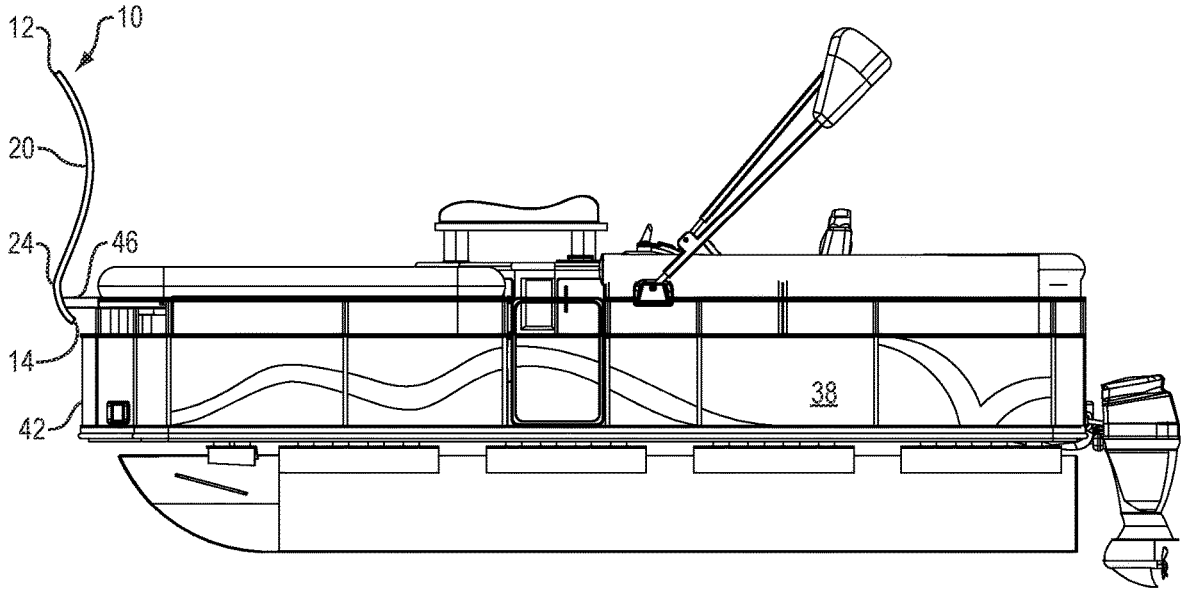

Now referring to FIGS. 2*a* and 2*b*, side views of alternative embodiments of windshield 10 that also include substantially flat section 24 are provided. Substantially flat section 24 is disposed between concave section 20 and bottom edge 14 of windshield 10. Substantially flat section 24 may be completely flat, as shown in FIG. 2*a*, or convex, as shown in FIG. 2*b*. Attachment means 46 for attaching windshield 10 to boat 100 are visible. Attachment means 46 may be any commonly used in the art. In this view, attachment means 46 are a simple post affixed on end to bow 42 of boat 100 and on the other end to windshield 10.

Figure 3A:
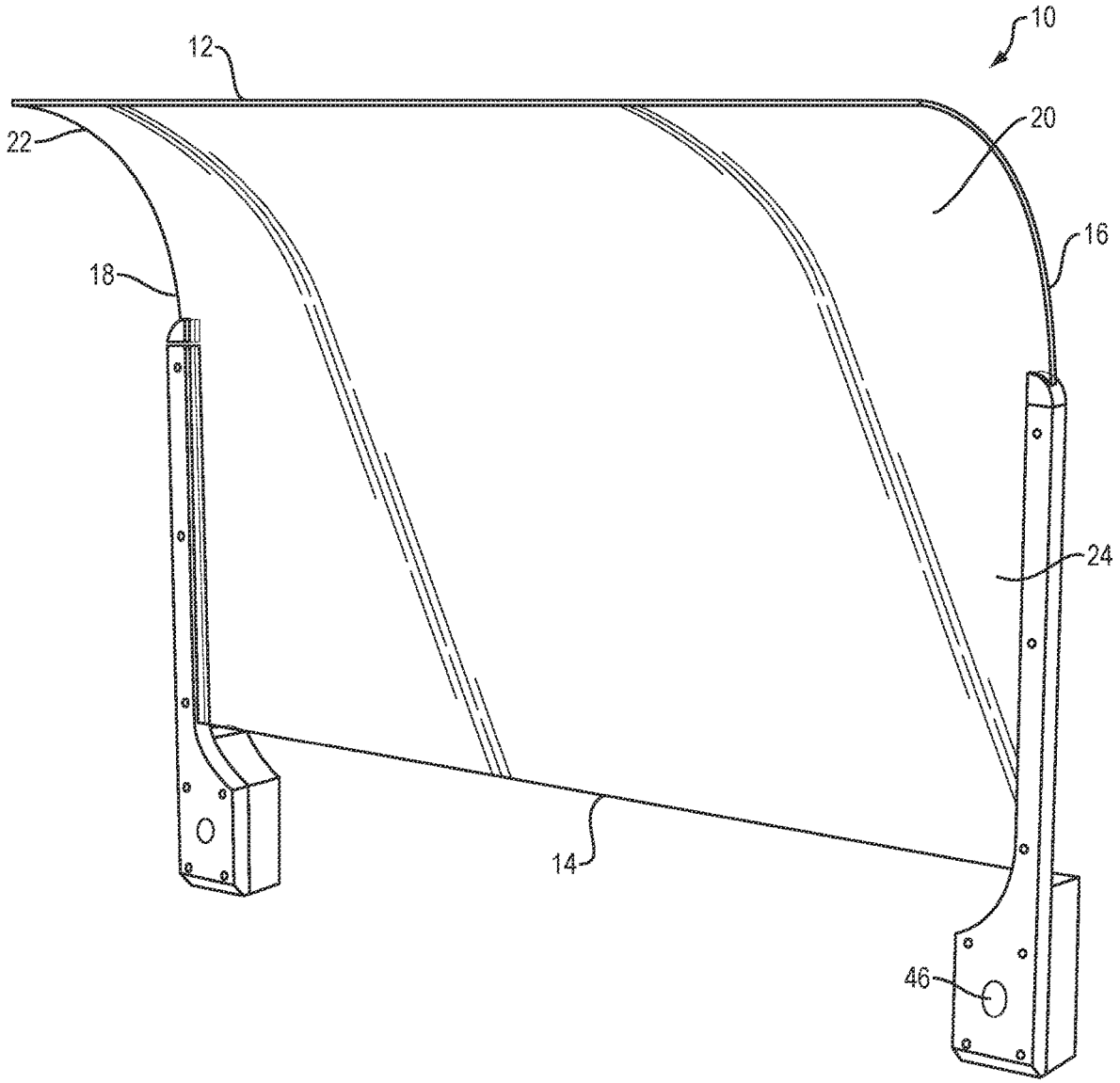
FIG. 3*a* is a perspective view of the front of a windshield of the present invention.
Figure 3B:
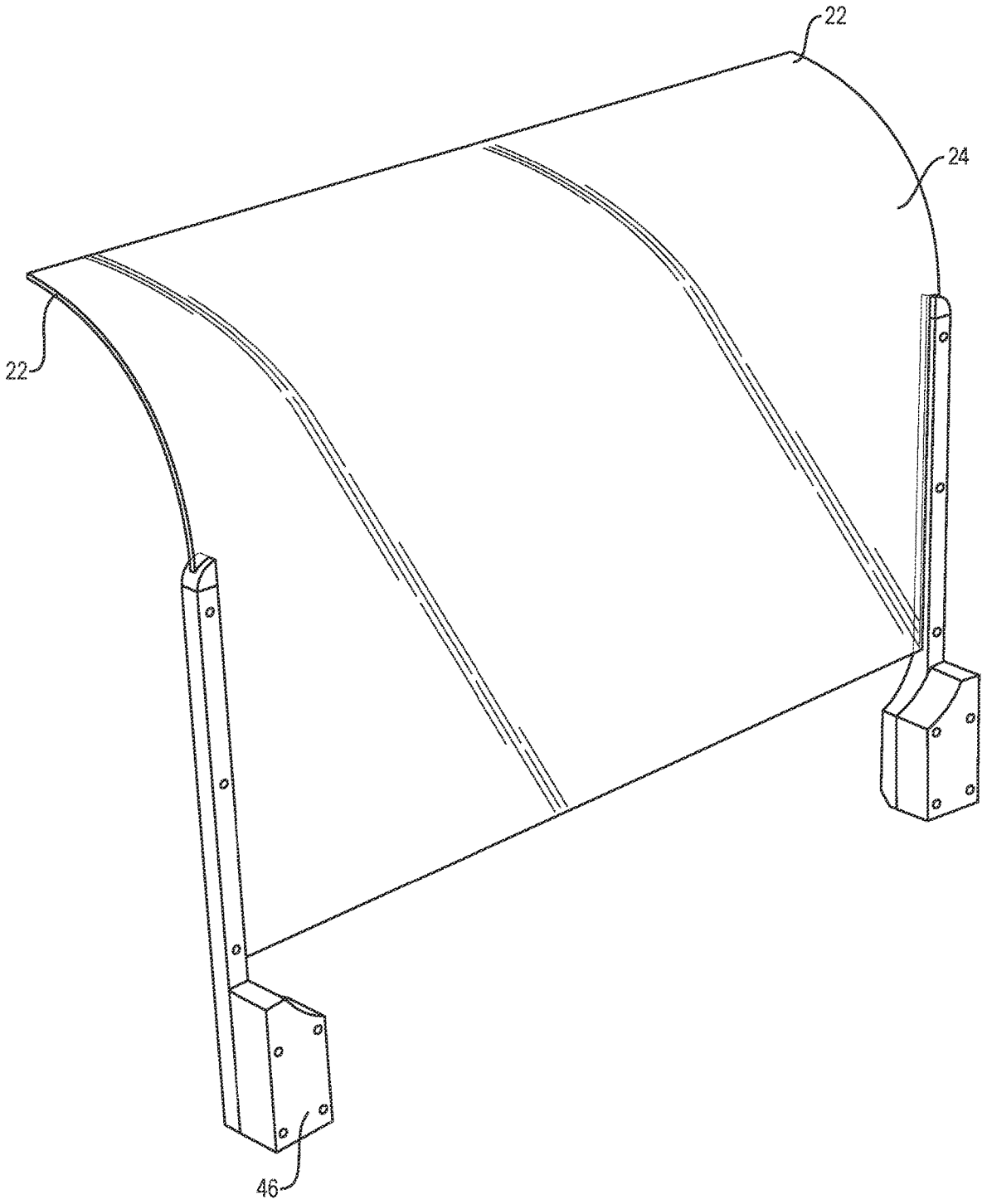
FIG. 3*b* is a perspective view of the back of a windshield of the present invention.

Now referring to FIGS. 3*a* and 3*b*, front and back perspective views of a preferred windshield 10 of the present invention are provided. Concave section 20 is seamlessly integrated to the top of substantially flat section 24. In this case, substantially flat section 24 is completely flat and is quite a bit larger in surface area than concave section 20. Curvature 22 describes approximately 90 degrees of a circle, as discussed below with reference to FIG. 5. In this embodiment, curvature 22 is always between 80 and 100 degrees of a circle. The preferred attachment means 46 are shown on right and left sides 16, 18 of windshield 10 and are discussed in more detail below with reference to FIGS. 4*a*-4*c*.

Figure 3C:
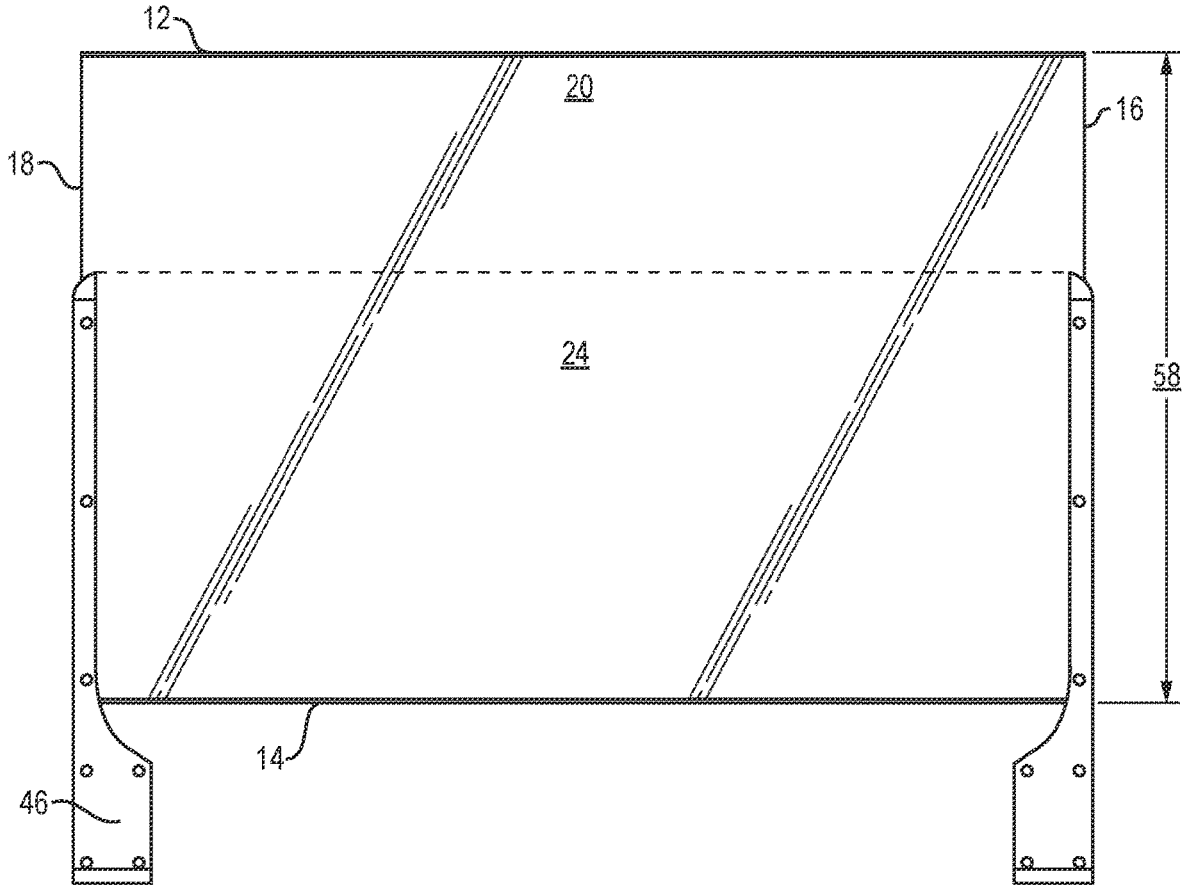
FIG. 3*c* is a front view of a windshield of the present invention.
Figure 3D:
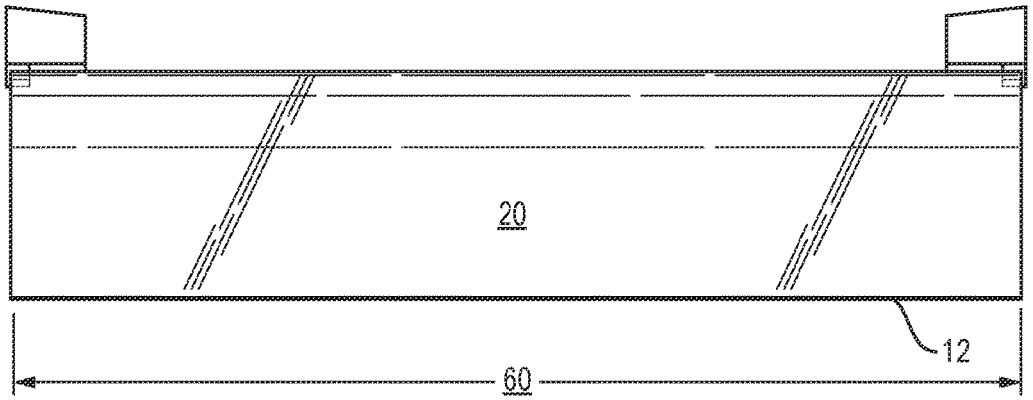
FIG. 3*d* is a top down view of a windshield of the present invention.

Now referring to FIGS. 3*c* and 3*d*, front and top down views of the preferred windshield 10 of the present invention are provided. The dashed line in FIG. 3*c* represents the inflection point between concave section 20 and substantially flat section 24 (which, again, is completely flat in this preferred embodiment). Viewed from the top, as in FIG. 3*d*, only concave section 20 is visible as it is understood that substantially flat section 24 drops down into the page at the top of the Figure. Top edge 12 is parallel to bottom edge 14. Right side 16 is parallel to left side 18. As discussed above, not all embodiments of windshield 10 include parallel top and bottom edges 12, 14 and right and left sides 16, 18.

Windshield 10 has height 58 and width 60. It is understood that in embodiments of windshield 10 where top and bottom edges 12, 14 and/or right and left sides 16, 18 are not parallel, height 58 and width 60 may vary within a single windshield 10. In the preferred embodiment of windshield 10 shown in FIGS. 3*a*-3*d*, however, height 58 and width 60 are static. Height 58 and 60 may vary a great deal depending on the size of the boat to which windshield 10 will be attached. Windshield 10 in FIGS. 3*c* and 3*d* has a height 58 of approximately 26 inches and a width 60 of approximately 50 inches, which may be standard-sized. Again, a standard-sized windshield 10 may be adopted for ease of manufacture, understanding that custom shapes and sizes may be manufactured and that there may be several standard-sized sets of dimensions.

Figure 4C:
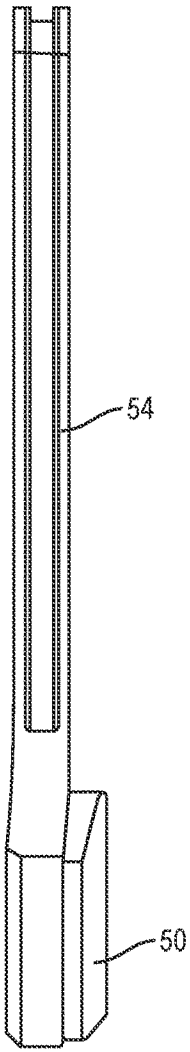
FIG. 4*c* is a side view of the preferred attachment means as shown in FIG. 4*a*.
Figure 4B:
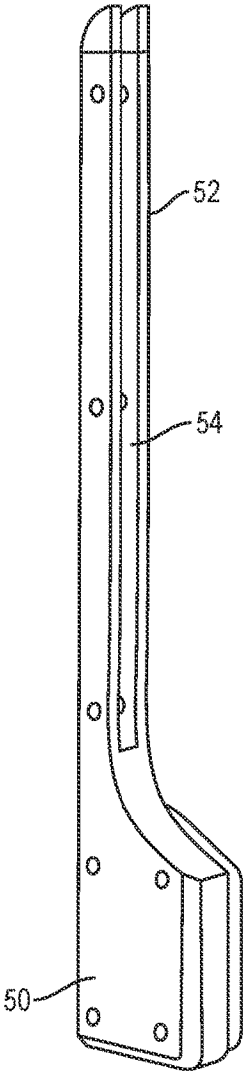
FIG. 4*b* is a perspective view of the preferred attachment means as shown in FIG. 4*a*.
Figure 4A:
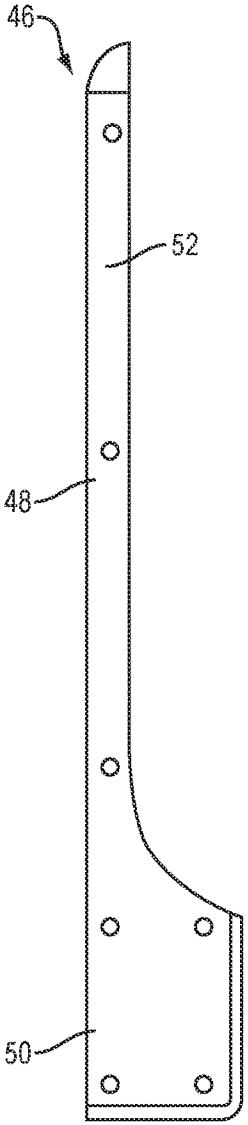
FIG. 4*a* is a front view of a preferred attachment means.

Now referring to FIGS. 4*a*-4*c*, front, perspective, and side views of the preferred attachment means 46 are provided. This preferred embodiment of attachment means 46 include a pair of upright members 48, each of which includes a boat attachment section 50 and a windshield attachment section 52. Boat attachment section 50 will be secured to the boat through any means commonly used in the art, but preferably by screws, as shown. Boat attachment section 50 is shown wider than windshield attachment section 52, but it is understood that the section 50 may be any shape or size conducive to secure attachment to the boat. Windshield 10 will be positioned and secured between windshield attachment sections 52 of the pair of attachment means 46. As shown in FIGS. 3*a*-3*d*, right and left sides 16, 18 of the preferred windshield 10 are parallel to one another, and windshield 10 has a large substantially flat section 24. The windshield attachment section 52 shown in FIGS. 4*a*-4*c* is adapted for this preferred embodiment of windshield 10. Windshield attachment section 52 includes a windshield slot 54 sized to accommodate the straight sides of the large substantially flat section 24. As shown, screws and screw holes or similar may also be included in the windshield attachment section 52 to ensure the windshield 10 sits securely within windshield slots 54 with minimal movement therein. When attachment means 46 require that a hole be cut through the windshield 10, such as with these preferred attachment means 46, rubber gasketing may be deployed around the hole so as to reduce the chance of crack fracturing from the holes.

The attachment means 46 shown in FIGS. 4*a*-4*c* are preferred and adapted for use with the preferred windshield 10, as shown in FIGS. 3*a*-3*c*. It is understood, however, that many attachment means 46 of many forms may be included as part of the present invention. It is only required that attachment means 46 include a boat attachment section 50 adapted for attachment to the boat and a windshield attachment section 52 adapted for attachment to the windshield 10, such that the overall attachment means 46 hold the windshield 10 securely in place with respect to the boat. The attachment means 46 shown in FIGS. 4*a*-4*c*, would not accommodate the windshield 10 shown in FIG. 1*a*, for example, because that windshield 10 does not include a substantially flat section 24 that would be held by the windshield slots 54. One of at least ordinary skill in the art will recognize that different attachment means 46 could be readily adapted for the shapes, sizes, and variations of the various embodiments of windshield 10. Each of these variations of the attachment means 46 is considered to be within the scope of the present invention.

The preferred windshield 10, as shown in FIGS. 3*a*-3*d* and the preferred attachment means 46, as shown in FIGS. 3*a*-4*c*, are typically not used in conjunction with any of the adjustment means 26, 28, 30, 32, or 34, discussed below with reference to FIGS. 7*a*-7*f*. Instead, windshield 10 is bolted to the boat at a fixed point that will provide an optimized isolation mount angle. This angle at which windshield 10 is mounted onto the boat will optimize for the amount and position of the space behind the windshield 10 that is protected from the slipstream versus overall performance of the boat. The size and shape of windshield 10 will also affect the amount and position of the protected space.

Figure 5:
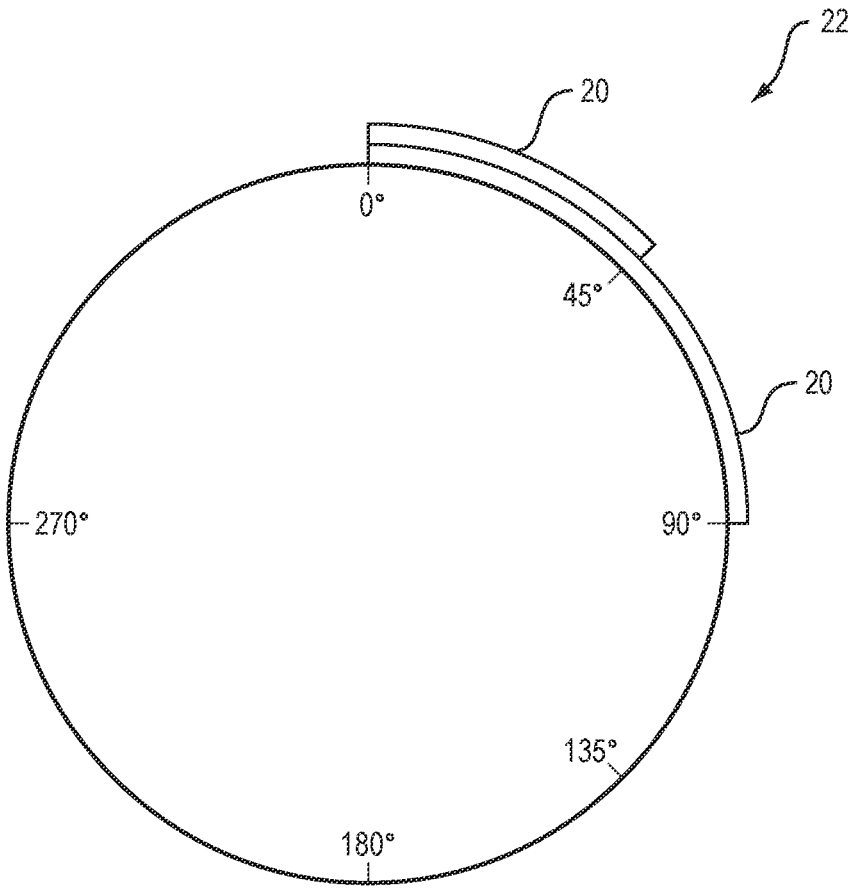
FIG. 5 is a detail of the curvature of the concave section of the present invention.

Now referring to FIG. 5, a detail of curvature 22 of concave section 20 is provided. Curvature 22 preferably describes between 45 and 90 degrees of a circle. As illustrated by the two concave sections 20 superimposed around the circle depicted, the lower the number of degrees, the flatter the curvature 22 appears to be, the higher the number of degrees, the rounder the curvature 22 appears to be. As used herein, when it is said that the curvature of the concave section describes a number of degrees of a circle, it is referencing the concept illustrated in FIG. 5. It is understood that not all concave sections 20 have curvature 22 that tracks perfectly to a circle. The concave section 20 may flatten slightly toward the top or bottom edges 12, 14, for example. In embodiments that include a substantially flat section 24, for example, the concave section 20 may gradually flatten into the inflection point where the concave section 20 and the substantially flat section 24 meet.

Figure 6A:
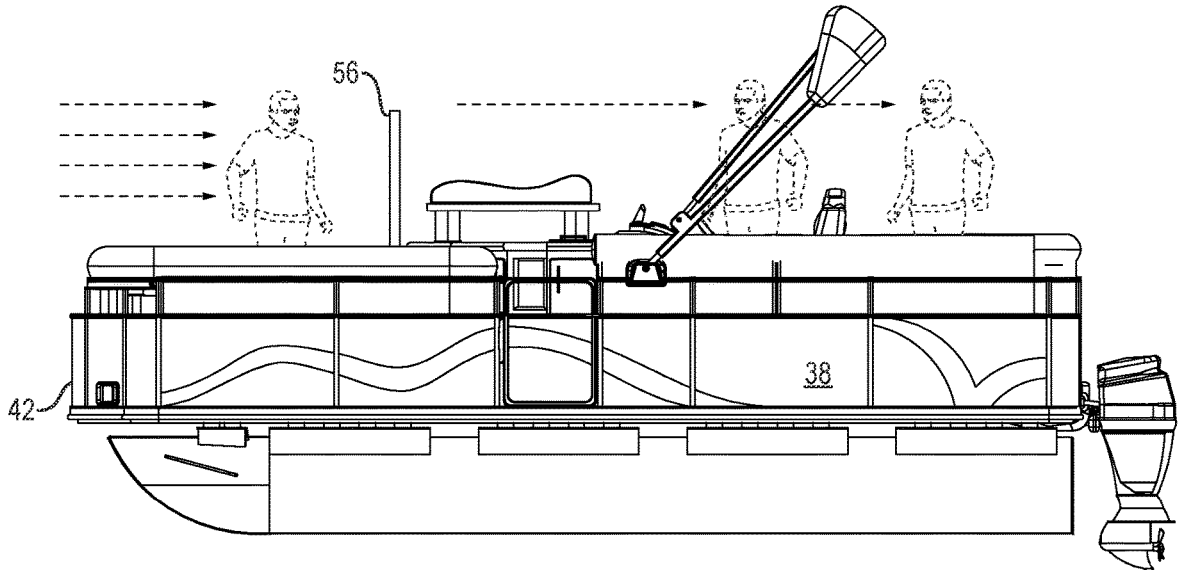
FIG. 6A (PRIOR ART)
FIGS. 6*a* and 6*b* are side views illustrating slipstreams over a prior art boat and a boat of the present invention, respectively.
Figure 6B:
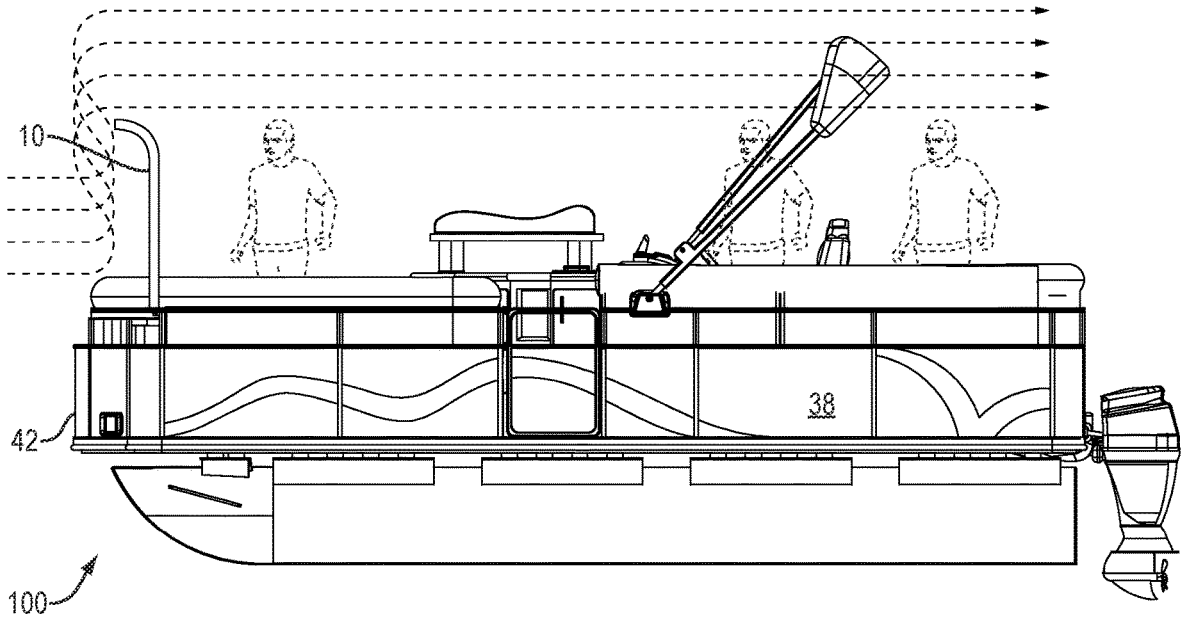

Now referring to FIGS. 6*a* and 6*b*, side views illustrating slipstreams over a prior art boat and a boat 100 of the present invention are provided, respectively. In FIG. 6*a*, a flat prior art windshield 56 is disposed mid-ship. The wind hits the passenger at the bow 42 of the boat, who has no protection at all. The passengers behind prior art windshield 56 are partially protected but the slipstream flows straight back from the top of prior art windshield 56 to hit them in the face, thus providing an uncomfortable ride. In boat 100 of the present invention, on the other hand, the slipstream moves up and over windshield 10, which is disposed at the bow 42 of the boat 100. All the passengers can enjoy a smooth comfortable ride as the slipstream passes over them thanks to the aerodynamics of windshield 10.

Figure 7A:
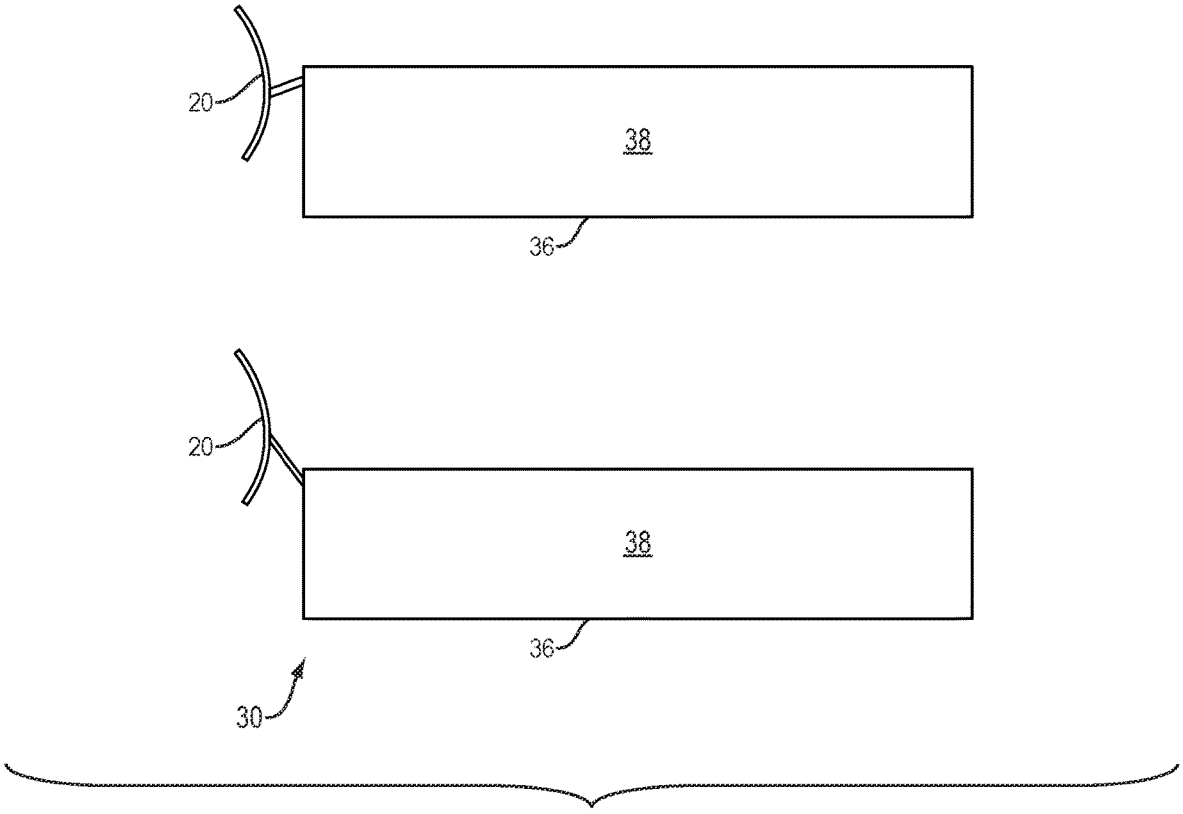
FIG. 7*a* is a representation of height adjustment.
Figure 7B:
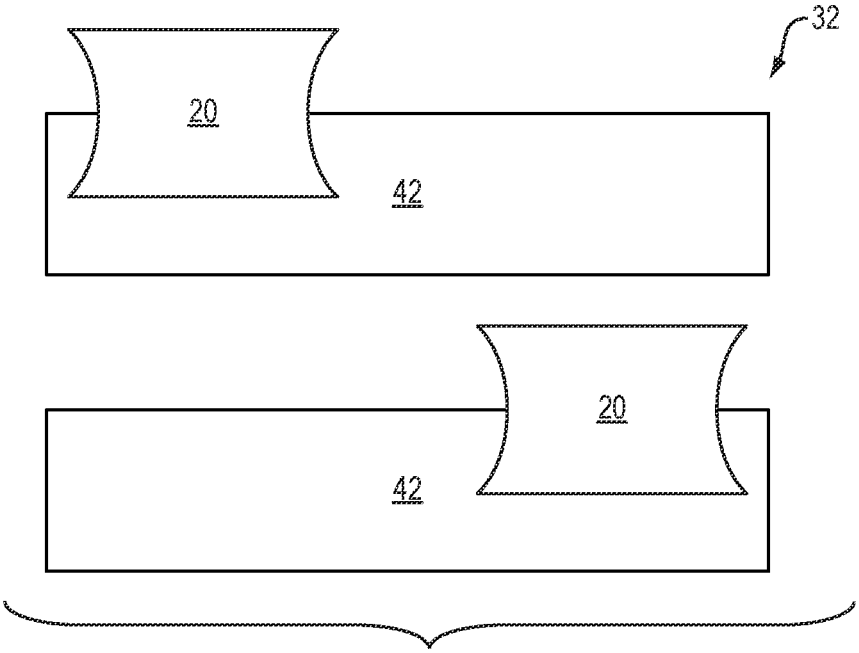
FIG. 7*b* is a representation of position adjustment.
Figure 7C:
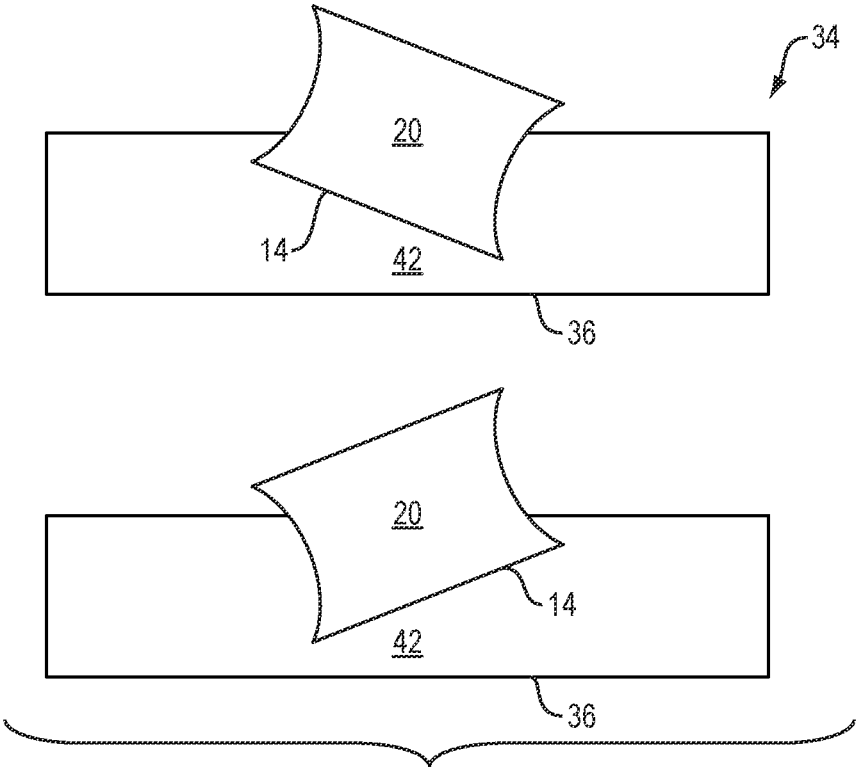
FIG. 7*c* is a representation of rotation adjustment.
Figure 7D:
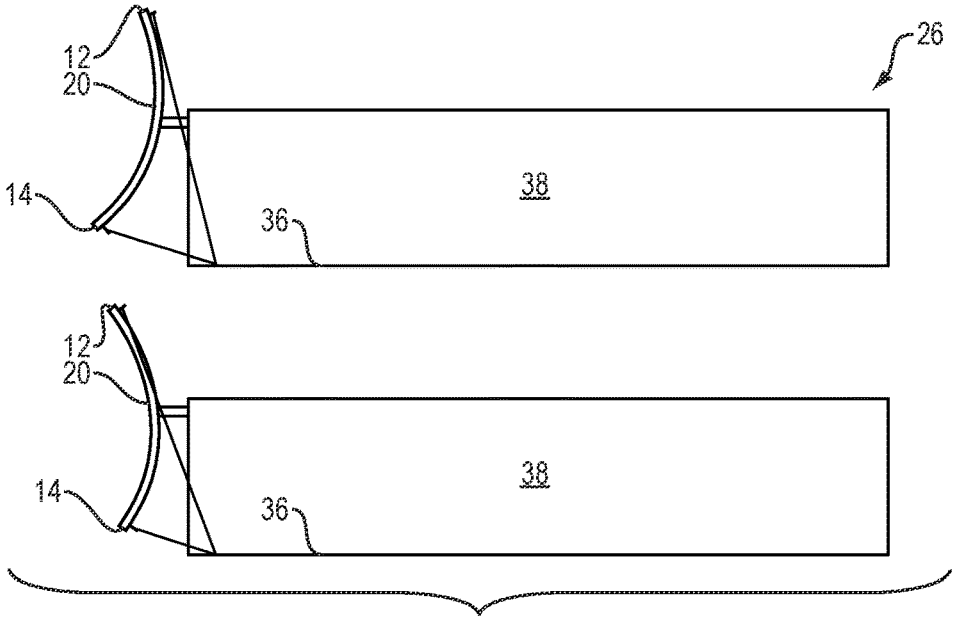
FIG. 7*d* is a representation of vertical angle adjustment.
Figure 7E:
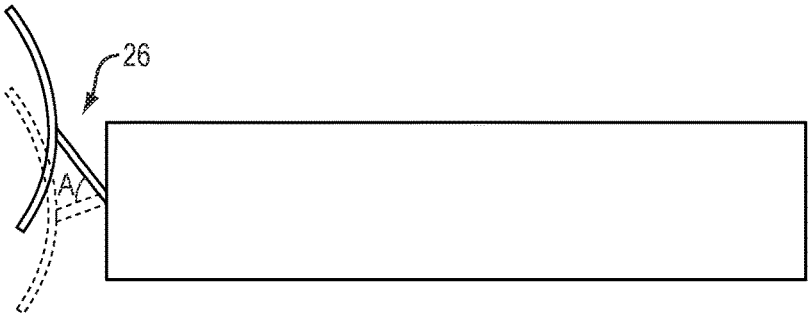
FIG. 7*e* is a diagram indicating degrees of vertical angle adjustment.
Figure 7F:
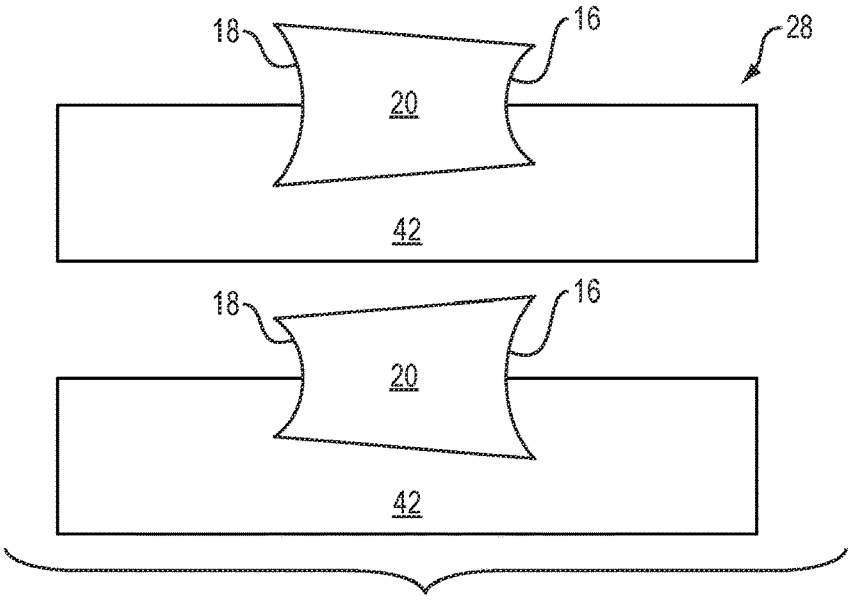
FIG. 7*f* is a representation of lateral angle adjustment.

Now referring to FIGS. 7*a*-7*f*, various adjustments of concave section 20 are illustrated. In FIG. 7*a*, height adjustment 30 is illustrated. That is to say, the entire concave section 20 is adjusted up and down relative to the fixed deck 36 of boat 100. Height adjustment means make this height adjustment 30. In FIG. 7*b*, position adjustment 32 is illustrated. That is to say, the entire concave section 20 is adjusted side to side relative to the bow 42 of boat 100. Position adjustment means make this position adjustment 32. It is understood that concave section 20 may also be adjusted to a position on boat 100 other than bow 42, but there is little practical need for such a position adjustment. In FIG. 7*c*, rotation adjustment 34 is illustrated. That is to say, concave section 20 generally stays in the same position, but is rotated so that the angle between bottom edge 14 and deck 36 changes. Rotation adjustment means make this rotation adjustment 34. In FIG. 7*d*, vertical angle adjustment 26 is illustrated. Again, concave section 20 generally stays in the same position, but it rotates so that the distance between top edge 12 and a fixed point on deck 36 changes and/or the distance between bottom edge 14 and a fixed point on deck 36 changes. Vertical angle adjustment means make this vertical angle adjustment 26. In FIG. 7*e*, a diagram indicating the degrees of vertical angle adjustment is provided. Vertical angle adjustment 26 provides an angle A of adjustment. At the top in solid lines, windshield 10 is shown adjusted to one extreme of angle A. At the bottom in dashed lines, windshield 10 is shown adjusted to the other extreme of angle A. Angle A is at least 20 degrees and is preferably 30-60 degrees. Finally, in FIG. 7*f*, lateral angle adjustment 28 is illustrated. Concave section 20 rotates so that the distance between right side 16 and a fixed point on bow 42 changes and/or the distance between left side 18 and a fixed point on bow 42 changes. In other words, in the top view of FIG. 7*f*, left side 18 is closer to the viewer and farther from bow 42 and in the bottom view of FIG. 7*f*, right side 16 is closer to the viewer and farther from bow 42. Lateral angle adjustment means make this lateral angle adjustment 28.

Although the present invention has been described in considerable detail with reference to certain preferred versions thereof, other versions would be readily apparent to those of ordinary skill in the art. Therefore, the spirit and scope of the description should not be limited to the description of the preferred versions contained herein.

I claim:

1. A boat windshield comprising:

a top edge and a bottom edge;

a right side and a left side, connecting said top and bottom edges;

a concave section extending down from said top edge and extending between said right and left sides, wherein said concave section comprises a curvature; and attachment means for attaching said windshield to a boat, wherein said attachment means comprise a boat attachment section and a windshield attachment section;

wherein:

said windshield further comprises a substantially flat section adjacent to and below said concave section, such that said substantially flat section is disposed between said concave section and said bottom edge; and said attachment means comprises two upright members and said windshield attachment section of each of said two upright members comprises a windshield slot sized to accommodate said right or left side of said substantially flat section of said windshield.

2. The boat windshield as claimed in claim 1, wherein said curvature of said concave section describes between 45 and 90 degrees of a circle.

3. The boat windshield as claimed in claim 1, wherein said concave section extends between said top edge and said bottom edge.

4. The boat windshield as claimed in claim 1, wherein said right and left sides are parallel.

5. The boat windshield as claimed in claim 1, wherein said top and bottom edges are parallel.

6. The boat windshield as claimed in claim 1, wherein said substantially flat section is completely flat.

7. The boat windshield as claimed in claim 1, wherein said substantially flat section is convex as compared to said concave section.

8. A boat comprising a bow, an aft, a deck, and at least one windshield, wherein said windshield comprises:

a top edge and a bottom edge;

a right side and a left side, connecting said top and bottom edges;

a concave section extending down from said top edge and extending between said right and left sides, wherein said concave section comprises a curvature that bulges toward said aft of said boat; and attachment means for attaching said windshield to said bow, wherein said attachment means comprise a boat attachment section and a windshield attachment section;

wherein:

said windshield further comprises a substantially flat section adjacent to and below said concave section, such that said substantially flat section is disposed between said concave section and said bottom edge; and said attachment means comprises two upright members and said windshield attachment section of each of said two upright members comprises a windshield slot sized to accommodate said right or left side of said substantially flat section of said windshield.

9. The boat as claimed in claim 8, wherein said curvature of said concave section of said windshield describes between 45 and 90 degrees of a circle.

10. The boat as claimed in claim 8, wherein said concave section of said windshield extends between said top edge and said bottom edge.

11. The boat as claimed in claim 8, wherein said windshield is disposed at said bow of said boat.

* * * * *